US007008189B2

(12) United States Patent
Jarrah et al.

(10) Patent No.: US 7,008,189 B2
(45) Date of Patent: Mar. 7, 2006

(54) CENTRIFUGAL FAN

(75) Inventors: Yousef Jarrah, Tucson, AZ (US); Desmond Riedel, Phoenix, AZ (US)

(73) Assignee: Minebea Co., Ltd., (JP)

( * ) Notice: Subject to any disclaimer, the term of this patent is extended or adjusted under 35 U.S.C. 154(b) by 0 days.

(21) Appl. No.: 10/409,374

(22) Filed: Apr. 7, 2003

(65) Prior Publication Data

US 2004/0197192 A1 Oct. 7, 2004

(51) Int. Cl.
*B63H 1/00* (2006.01)

(52) U.S. Cl. ..... 416/175; 416/179; 416/181; 415/206

(58) Field of Classification Search ..... 416/175, 416/179, 181, 182, 183; 415/206, 211.1, 415/211.2
See application file for complete search history.

(56) References Cited

U.S. PATENT DOCUMENTS

| | | | | |
|---|---|---|---|---|
| 318,884 | A | 5/1885 | Dwight | |
| 902,533 | A | 10/1908 | Hubbard | |
| 1,001,956 | A | 8/1911 | Holson | |
| 1,450,936 | A | 4/1923 | Barton | |
| 1,856,587 | A | 5/1932 | Persons | |
| 1,985,022 | A | 12/1934 | Bothezat | |
| 2,313,413 | A | 3/1943 | Weske | |
| 2,465,625 | A | 3/1949 | Aue | |
| 2,704,516 | A | 3/1955 | Mock et al. | |
| 3,127,093 | A | 3/1964 | Sudrow | |
| 3,201,032 | A | 8/1965 | Gelbard | |
| 3,597,117 | A * | 8/1971 | Zoehfeld | 417/354 |
| 3,904,308 | A | 9/1975 | Ribaud | |
| 4,132,912 | A * | 1/1979 | Wright | 310/62 |
| 4,521,154 | A * | 6/1985 | Corbett | 416/175 |
| 4,589,822 | A | 5/1986 | Clausen et al. | |
| 5,387,087 | A * | 2/1995 | Chen | 416/188 |
| 5,931,640 | A * | 8/1999 | Van Houten et al. | 416/128 |
| 6,027,383 | A * | 2/2000 | Broinowski | 440/38 |
| 6,042,335 | A * | 3/2000 | Amr | 415/208.1 |
| 6,105,206 | A | 8/2000 | Tokumaru et al. | |
| 6,210,109 | B1 | 4/2001 | Will et al. | |
| 6,210,118 | B1 | 4/2001 | Egawa et al. | |
| 6,435,828 | B1 * | 8/2002 | Bostwick | 416/175 |
| 6,663,342 | B1 * | 12/2003 | Huang et al. | 415/121.2 |

OTHER PUBLICATIONS

PCT International Search Report for International Patent Application Serial No. PCT/US04/10790.

* cited by examiner

*Primary Examiner*—Hoang Nguyen
(74) *Attorney, Agent, or Firm*—Townsend and Townsend and Crew LLP

(57) ABSTRACT

A centrifugal fan and a rotor for a centrifugal fan comprising axial blades, straight blades, and a hub having a radius that increases as a function of distance from the fan inlet.

9 Claims, 8 Drawing Sheets

FIG. 1
PRIOR ART
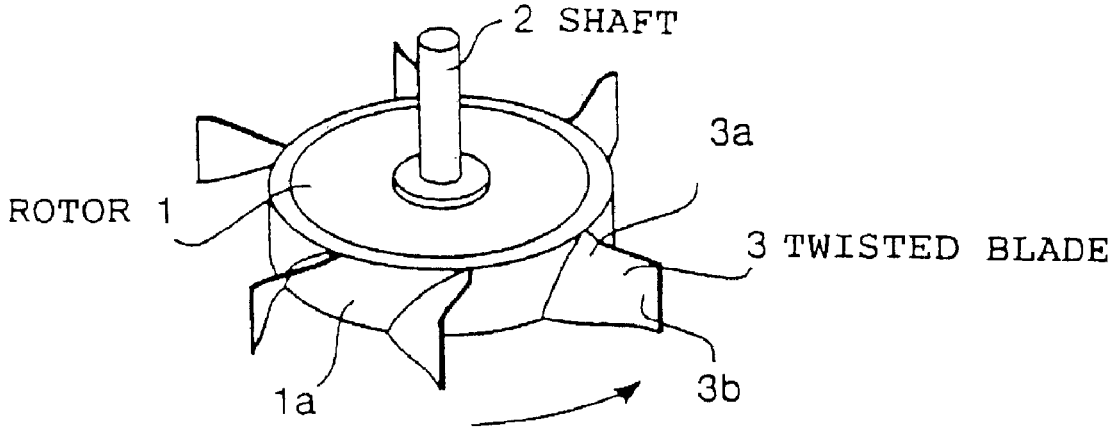
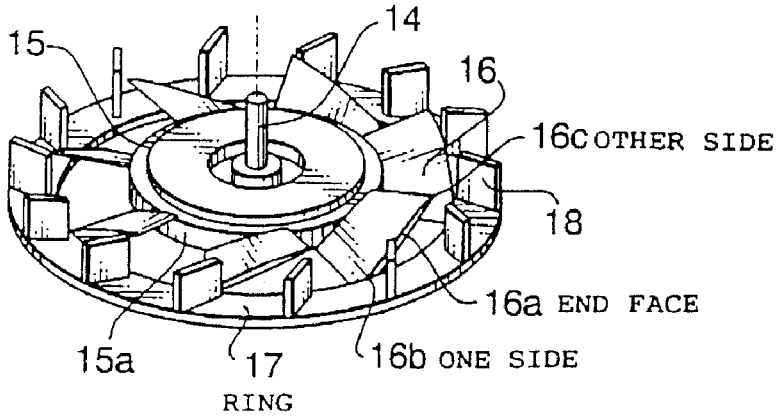
FIG. 1A
PRIOR ART

CENTRIFUGAL FAN

BACKGROUND OF THE INVENTION

The present invention relates to a centrifugal fan that is capable of generating a high air flow. Such fans are useful for cooling densely packed electronic components.

DESCRIPTION OF RELATED ART

Many modern electronic devices, such as main frame computers, are small in size and they have densely packed electronic components that generate a large amount of heat. A fan with high airflow is required to remove this large amount of heat. However, the flow resistance caused by the densely packed electronic components results in a high back pressure being generated within the system that the fan must overcome. Accordingly, there is a need for a small fan that can generate a high airflow into a high pressure environment.

The related art includes axial fans and centrifugal fans. Axial fans have an inlet and an outlet that are along the axis of rotation of the fan's blades. Whereas, centrifugal fans have an inlet that is along the axis of rotation and an outlet that is perpendicular to the axis of rotation. Axial fans utilize either air foil blades or angled blades (blades which are angled in the plane determined by the axis of rotation and a line tangent to the direction of rotation), which are capable of pulling a large amount of air into the fan and of generating a high volume airflow into a low pressure environment. Centrifugal fans generally utilize straight blades that impart a large amount of energy to the air such that it can be forced into a high pressure environment. However, straight blades are not capable of drawing in a large amount of air and centrifugal fans using straight blades must be of large size to generate a large airflow.

To increase the low pressure air flow in a centrifugal fan, it is known to use angled blades in the centrifugal fan. However, the use of angled blades instead of straight blades reduces the fans performance at high pressures. Additionally, as shown in FIG. 1 and in FIG. 1A, the prior art includes centrifugal fans that use both angled blades and straight blades or that use hybrid blades that are partially angled and partially straight. Such fans can be small in size and still provide substantial air flow at high pressures. However, it is desirable to have small sized fans that can provide even greater air flows at high pressures.

As also shown in FIG. 1, prior art centrifugal fans are generally constructed such that the fan blades are connected to a rotating hub of constant radius. However, as shown in FIG. 2, some prior art centrifugal fans utilize a rotating hub where the radius of the hub increases as a function of the distance from the fan inlet and where said function has a positive second derivative resulting in a hub that is substantially concave in shape. U.S. Pat. No. 6,210,109 explains that these concave shaped hubs allow the air flow to gradually change direction from being parallel to the axis of rotation to being perpendicular to the axis of rotation and thereby reduce the noise generated by the fan.

The prior art fans are either too large or they do not provide sufficient air flow at high pressure for effective use in small sized high heat generating electrical apparatuses with densely packed electronic components.

SUMMARY OF THE INVENTION

Centrifugal fans embodying this invention meet the need for a small cooling fan that can generate high airflow into a high pressure environment, such as the environment created in electrical apparatuses with densely packed electronic components.

In a first aspect of the present invention, a rotor for a centrifugal fan is comprised of a hub, where the radius of the hub increases as a function of the distance from the fan inlet; a plurality of straight blades; and a plurality of axial blades. Fans employing such rotors provide greater air flow at high pressure than prior art fans of similar size. Fan rotors according to this aspect of the invention may include a ring over the straight blades.

In another aspect of the present invention, a rotor for a centrifugal fan is provided with a substantially convex shaped rotating hub for rotating a plurality of blades. The convex shaped rotating hub provides improved high pressure air flow as compared to fans having rotating hubs with a constant radius or fans having rotating hubs that are concave in shape.

Fans within the scope of this invention may be comprised of a housing that encases a rotor of the type having a plurality of blades and a convex shaped hub. Additionally, fans within the scope of this invention may be comprised a housing that encases a rotor wherein the rotor is comprised a hub, which has a radius that increases as a function of the distance from the fan inlet; a plurality of straight blades; and a plurality of axial blades. Further, fans within the scope of this invention may be comprised of a housing that encases a rotor wherein the rotor is comprised of a hub, which has a radius that increases as a function of the distance from the fan inlet; and a plurality of combination blades. Fans embodying this invention may additionally include a fan cover.

BRIEF DESCRIPTION OF THE DRAWINGS

The present invention will be more easily understood with reference to the following drawings.

FIG. 1 is a perspective view of a prior art centrifugal fan rotor having a fixed radius hub and combination blades.

FIG. 1A is a perspective view of a prior art centrifugal fan rotor having a fixed radius hub, angled blades, and straight blades.

DETAILED DESCRIPTION OF THE PREFERRED EMBODIMENT

A description of a preferred embodiment of the present invention will now be given.

Figure 2:
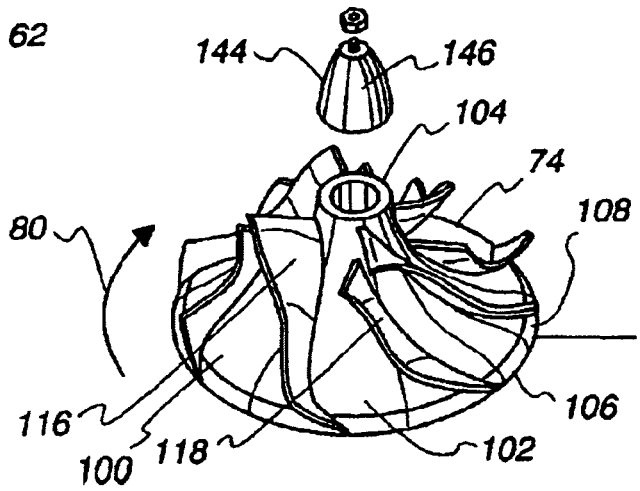
FIG. 2 PRIOR ART
FIG. 2 is a perspective view of a prior art centrifugal fan having centrifugal blades and a substantially concave hub having a radius that increases as a function of the distance from the fan inlet.
Figure 3:
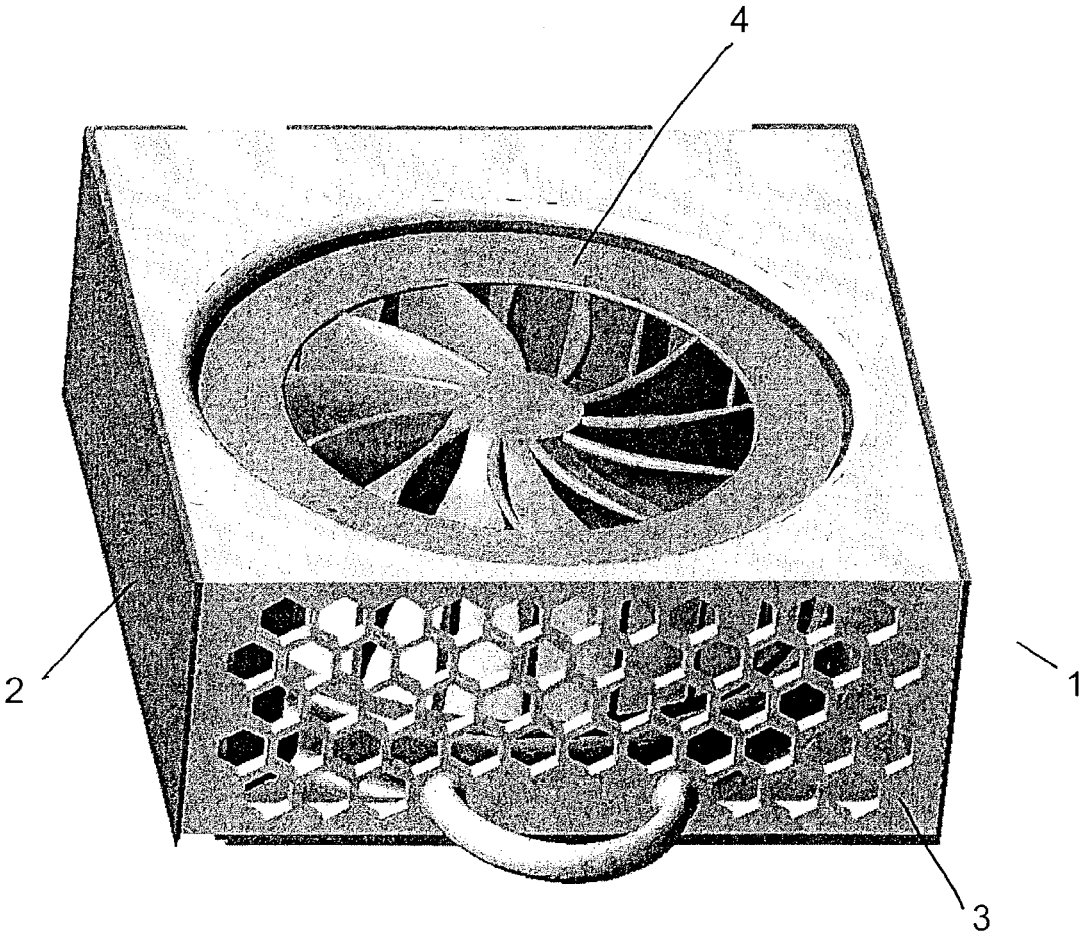
FIG. 3 is a top front view of a fan embodying the present invention.
Figure 3A:
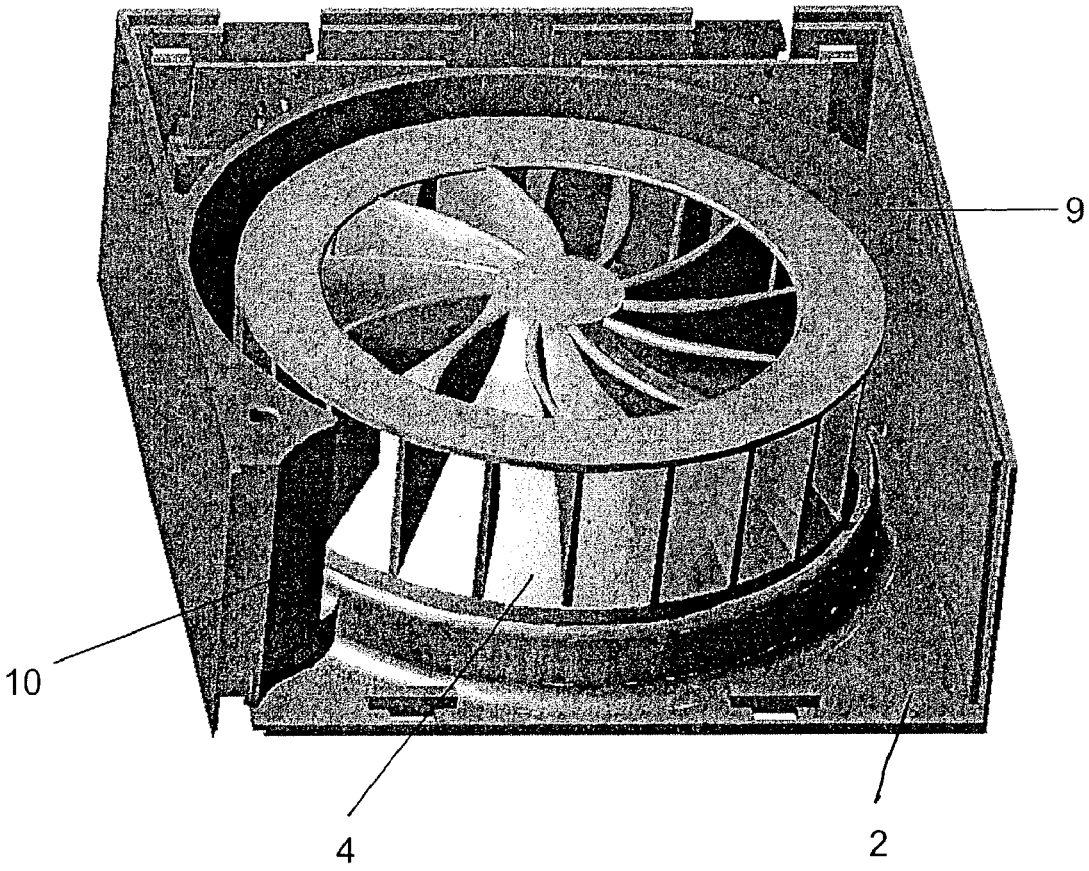
FIG. 3A is a top front view of a fan embodying the present invention with the cover removed.
Figure 3B:
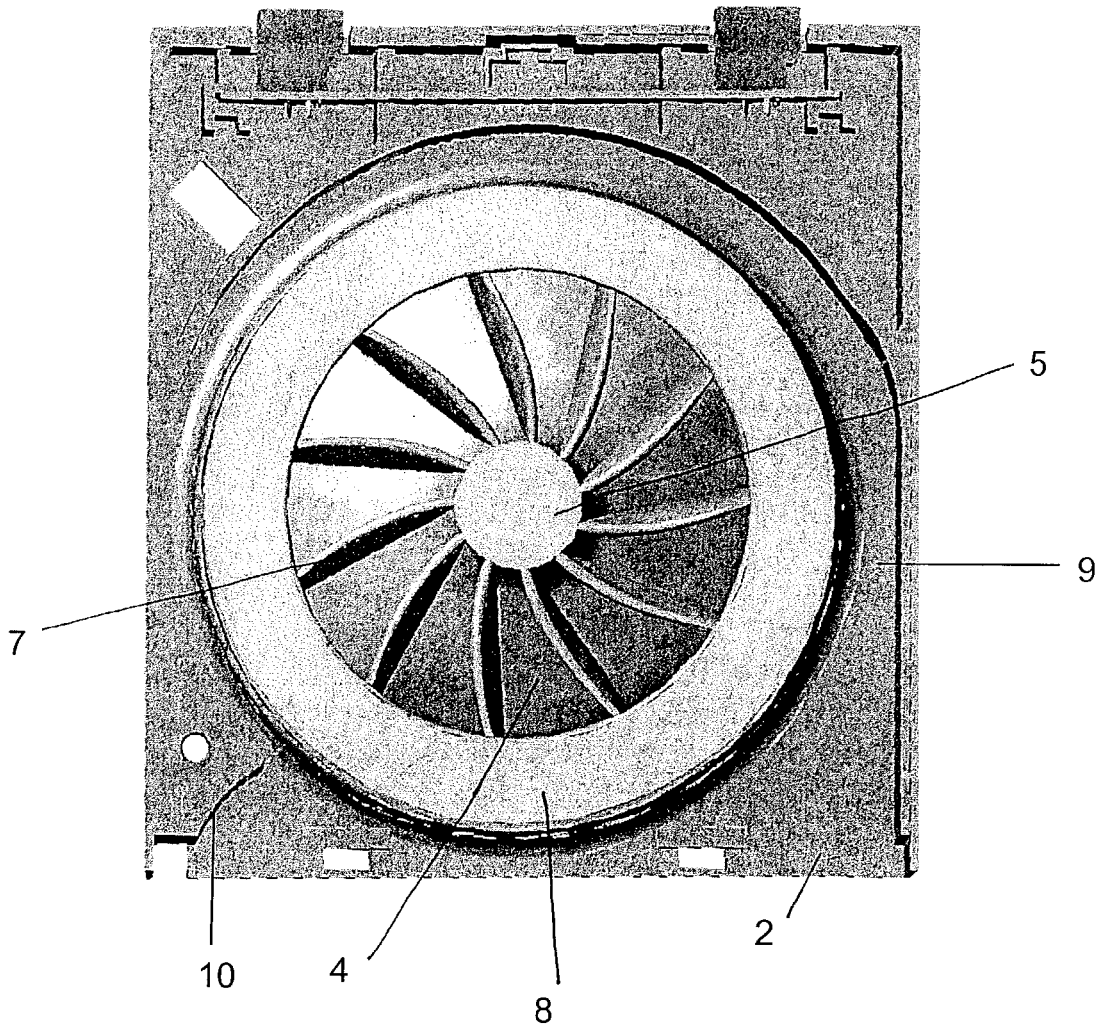
FIG. 3B is a top view of a fan embodying the present invention with the cover removed.

FIG. 3 shows the preferred embodiment of a centrifugal fan embodying the present invention. Centrifugal fan 1 is comprised of a housing 2, a cover 3, and a rotor 4. Rotor 4 is rotated in a clockwise direction by a motor (not shown) to generate air flow into the top of fan 1 and out of the front of fan 1 through the holes in cover 3. As shown in FIGS. 3A and 3B, housing 2 includes an air flow channel 9 that helps to direct the air flow to the front of fan 1 such that it can be discharged.

The size of air flow channel 9 increases in the direction of rotation of rotor 4 such that it is most narrow at the front left of housing 2 and most wide at the front right of housing 2. Additionally, concave discharge surface 10 is formed at the front left of housing 2 from the most narrow portion of air flow channel 9 to the front left corner of fan 1. Curved discharge surface 10 efficiently directs airflow towards the front of fan 1.

Figure 4:
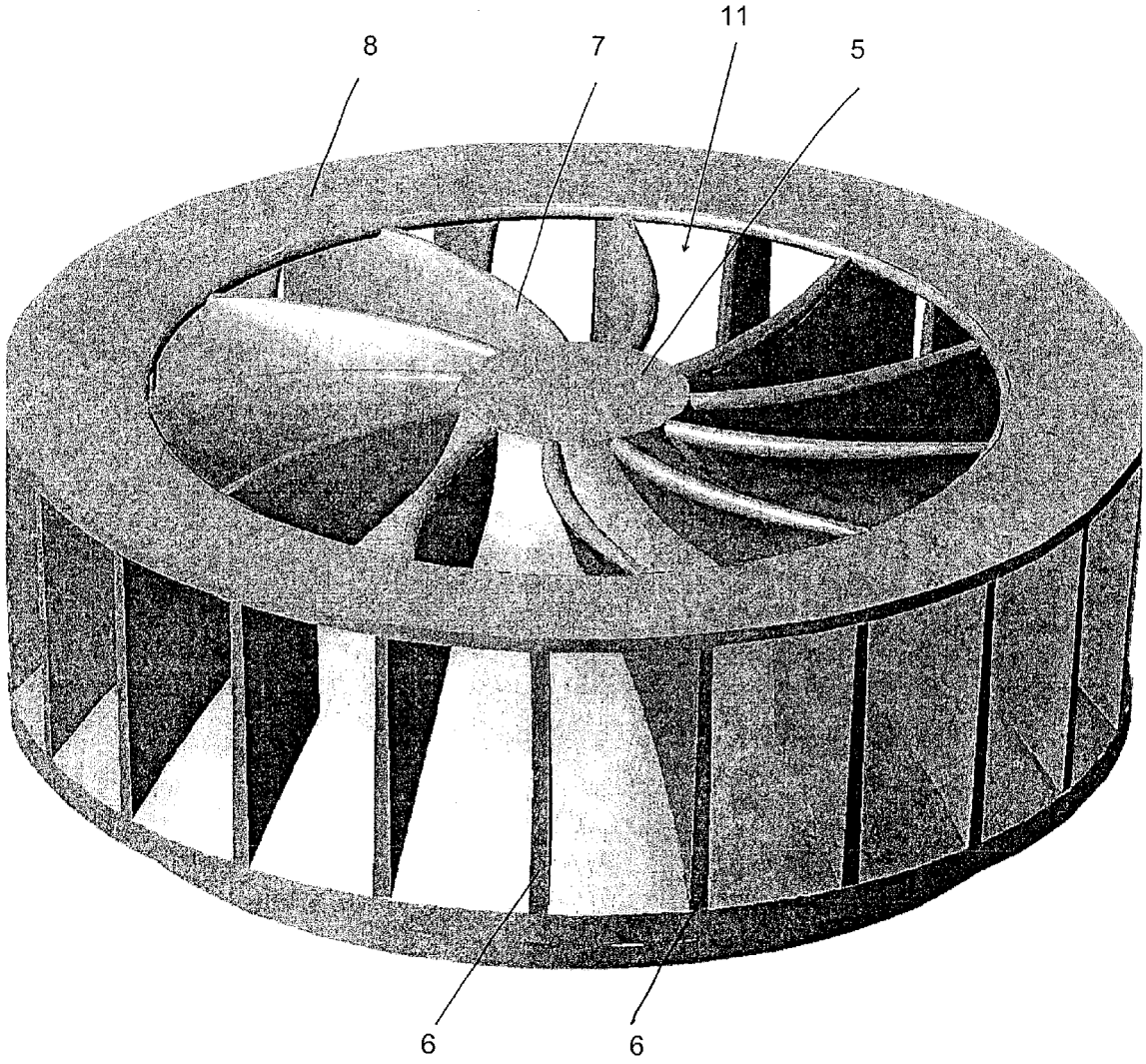
FIG. 4 is a top side view of a fan rotor embodying the present invention.

As shown in FIGS. 3B and 4, rotor 4 is comprised of hub 5, straight blades 6, axial blades 7, and ring 8. Ring 8 is positioned on top of straight blades 6. The Axial blades 7 are spaced equidistantly around hub 5. In the preferred embodiment, fan 1 contains twice as many straight blades 6 as axial blades 7 and a straight blade 6 is positioned at the end of each axial blade 7 contiguously therewith, such that a portion of the tip of each axial blade 7 is in contact with and affixed to a straight blade 6.

As shown in FIG. 4, in the preferred embodiment, axial blades 7 are angled blades. The angle of axial blades 7 decrease towards the tips of axial blades 7, which are connected to a straight blade 6. Alternatively, axial blade 7 may be integrally formed with straight blade 6. Additionally, axial blades 7 are curved such that the leading portion of each axial blade 7 in the direction of rotation is located at a position intermediate between the root of the axial blade 7 and the tip of the axial blade 7.

Figure 5:
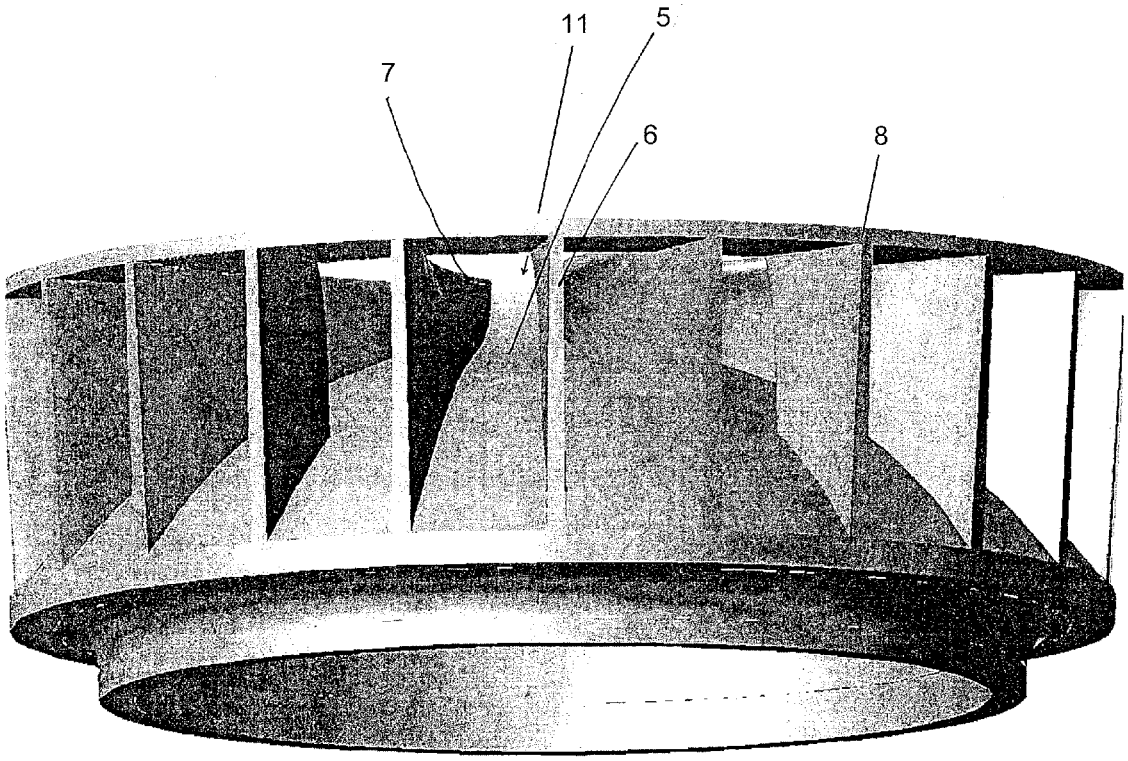
FIG. 5 is a bottom side view of a fan rotor embodying the present invention wherein the convex nature of the hub is shown.

As shown in FIGS. 4 and 5, the radius of hub 5 increases as a function of the distance from fan inlet 11. Additionally, hub 5 is substantially convex in shape, although a small portion of hub 5 (near the top of the fan) is concave. Both the increasing radius of hub 5 and its convex shape improve the performance of fan 1 at high pressure.

When the motor causes rotor 4 to rotate in a clockwise direction, axial fans 7 draw a large volume of air into the fan. The air travels over convex hub 5, which redirects the air flow such that it is substantially perpendicular to the axis of rotation, to the area of the fan containing straight blades 6. Straight blades 6 impart additional kinetic energy to the air and force the air out in a direction perpendicular to the axis of rotation. Ring 8 prevents air from flowing upwards out from straight blades 6. Housing 2 guides the air that has been expelled from straight blades 6 such that high energy air flows out from the openings in cover 3 at the front of fan 1.

In general, centrifugal fans use straight blades. Straight blades are non-airfoil blades that are not angled in the plane determined by the fan's axis of rotation and a line tangent to the blade's direction of rotation (they are positioned at an angle of approximately 90 degrees as measured from a line tangent to the blade's direction of rotation). Straight blades may be angled in other dimensions. If a straight blade is not covered with a ring positioned above the blade, the straight blade will force some air perpendicular to the desired direction of airflow. Accordingly, in the preferred embodiment, ring 8 is positioned above straight blades 6.

In a centrifugal fan using straight blades the fan's air flow is limited by the surface area of the straight blades. Accordingly, such fans must be large in size to generate a substantial amount of airflow. However, axial blades can be used to pull air into a centrifugal fan, thereby increasing the amount of air flow that the centrifugal fan is able to generate. Axial blades can be of two types airfoil blades or angled blades. Airfoil blades are blades comprised of an airfoil. Angled blades are non-airfoil blades that are angled in the plane determined by the axis of rotation and a line tangent to the direction of the blade's rotation (they are positioned at an angle substantially greater than zero degrees and substantially less than ninety degrees as measured from a line tangent to the blade's direction of rotation, although this angle need not be constant over the blades surface). In the preferred embodiment, axial blades 7 are angled blades, however, airfoil blades could be used.

Figure 6:
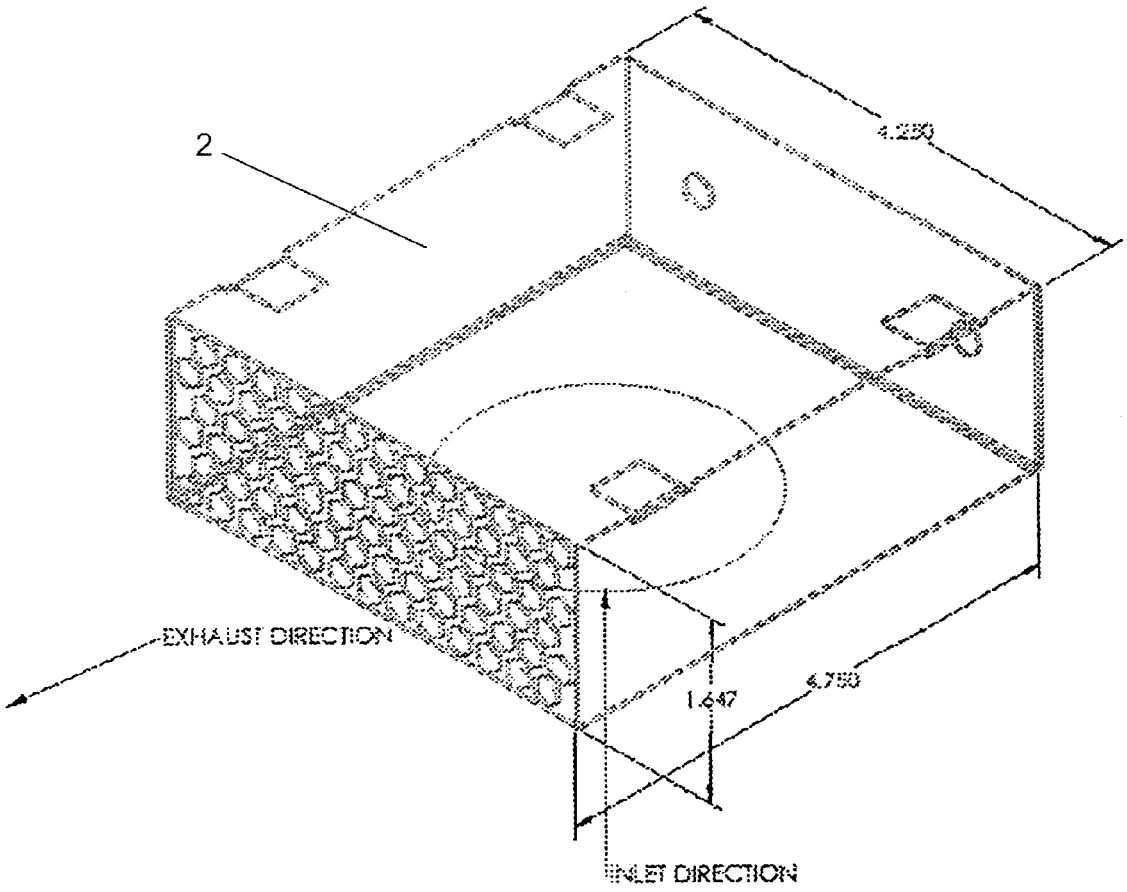
FIG. 6 is a view of the fan housing showing the specific dimensions of the preferred embodiment.

A fan configured as described above is capable of generating a high airflow into a flow restricted environment. For example, in the preferred embodiment, as shown in FIG. 6, a fan that is only 4.75 inches deep, 4.25 inches wide, and 1.647 inches tall is capable of generating greater than 30 CFM of airflow into an environment at a pressure of 0.8 inches of water when powered by a one inch low profile motor.

Instead of using both straight blades and angled blades (axial blades), a fan embodying the present invention could use combination blades, where combination blades are blades that combine the properties of angled blades and straight blades such as the blades shown in FIG. 1. A ring could be positioned over the top of the straight portion of the combination blades. Additionally, a fan embodying the present invention could use combination blades along with straight blades, angled blades, or both.

The drawings and descriptions of the preferred embodiment are made by way of example rather than to limit the scope of the inventions, and they are intended to cover, within the spirit and scope of the inventions, all such changes and modifications within the spirit of the invention.

What is claimed is:

1. A fan rotor comprising:

a conical-shaped hub;

a plurality of first blades connected to said hub, extending from a periphery of said hub to a central portion of said hub;

a plurality of second blades connected to said hub, extending from said periphery of said hub and less than the extent of said first blades; and a ring connected to top surfaces of said first blades and said second blades at said periphery of said hub, wherein peripheral portions of said first blades and said second blades are completely disposed between said hub and said ring.

2. The fan rotor of claim 1 wherein the blade angle of said first blades vary in the radial direction.

3. The fan rotor of claim 1 wherein said first blades have a non-perpendicular portion relative to a surface of said hub and a perpendicular portion relative to said surface of said hub.

4. The fan rotor of claim 1 wherein the blade angle of each first blade varies from an angle less than 90° near said central portion of said hub to an angle approximately equal to 90° at said periphery of said hub.

5. The fan rotor of claim 1 wherein a portion of each of said first blades between the center of said hub and said ring is airfoil shaped.

6. The fan rotor of claim 1 wherein said second blades are straight blades.

7. A fan rotor comprising:

a conical-shaped hub;

an axis of rotation about which said hub rotates;

a plurality of axial blades disposed on an upper surface of said hub, said axial blades extending radially from said axis to a periphery of said hub, said axial blades having a blade angle that varies in the radial direction;

a plurality of straight blades shorter in extent than said axial blades, and disposed at said periphery of said hub; and a ring connected to said axial blades and to said straight blades at peripheral portions thereof whereby said peripheral portions of said axial blades and of said straight blades are completely disposed between said upper surface of said hub and said ring.

8. The fan rotor of claim 7 wherein said axial blades have an angled portion relative to said upper surface of said hub and a perpendicular portion relative to said upper surface of said hub.

9. The fan rotor of claim 7 wherein the blade angle of said axial blades also vary in the axial direction.

* * * * *